US008753011B2

(12) United States Patent
Nanba et al.

(10) Patent No.: US 8,753,011 B2
(45) Date of Patent: Jun. 17, 2014

(54) EASILY OPENABLE FASTENER TAPE, PACKAGING BAG WITH EASILY OPENABLE FASTENER TAPE, AND METHOD OF MANUFACTURING EASILY OPENABLE FASTENER TAPE

(75) Inventors: Yoshinori Nanba, Chiba (JP); Kenichi Tanaka, Chiba (JP)

(73) Assignee: Idemitsu Unitech Co., Ltd, Tokyo (JP)

( * ) Notice: Subject to any disclaimer, the term of this patent is extended or adjusted under 35 U.S.C. 154(b) by 331 days.

(21) Appl. No.: 12/443,909

(22) PCT Filed: Sep. 28, 2007

(86) PCT No.: PCT/JP2007/069043
§ 371 (c)(1),
(2), (4) Date: Apr. 1, 2009

(87) PCT Pub. No.: WO2008/041647
PCT Pub. Date: Apr. 10, 2008

(65) Prior Publication Data

US 2010/0215291 A1 Aug. 26, 2010

(30) Foreign Application Priority Data

Oct. 2, 2006 (JP) ..... 2006-270488

(51) Int. Cl.
*B65D 33/16* (2006.01)
*A44B 1/04* (2006.01)

(52) U.S. Cl.
USPC ..... 383/63; 24/400; 24/DIG. 39

(58) Field of Classification Search
USPC ..... 383/63, 65, 64; 24/585.12, 399, 400, 24/584.1, DIG. 38–DIG. 41
See application file for complete search history.

(56) References Cited

U.S. PATENT DOCUMENTS 3,780,781 A * 12/1973 Uramoto ..... 383/204
4,191,230 A 3/1980 Ausnit
5,007,146 A * 4/1991 Meidan ..... 24/683
5,092,684 A 3/1992 Weeks (Continued)

FOREIGN PATENT DOCUMENTS

JP UM-A-52-116413 U 3/1951
JP UM-A-52-116413 W 3/1951

(Continued)

OTHER PUBLICATIONS

English Abstract of JP-UM-63-62349, B1.

(Continued)

*Primary Examiner* — Jes F Pascua
(74) *Attorney, Agent, or Firm* — Millen, White, Zelano & Branigan, P.C.

(57) ABSTRACT

A belt-shaped base of a male member of a zipper tape attached on an inner surface of a bag body includes a main body provided with an engagement portion, a thin portion connected to an opening-side of the main body, a thick portion connected to an opening-side of the thin portion and a projecting portion provided on the thick portion. A female member is also provided with the same arrangement. When the zipper tape is fused with the bag body, a gap is provided between the thin portion and a film of the bag body and between the thin portion and a film of the bag body, so that the thin portions are easily bent.

7 Claims, 5 Drawing Sheets

(56) References Cited

U.S. PATENT DOCUMENTS

| | | | | |
|---|---|---|---|---|
| 5,774,955 | A * | 7/1998 | Borchardt et al. | 24/584.1 |
| 6,009,603 | A * | 1/2000 | Gallagher | 24/585.12 |
| 6,345,911 | B1 | 2/2002 | Young et al. | |
| 6,899,460 | B2 * | 5/2005 | Turvey et al. | 383/33 |
| 2004/0078938 | A1 | 4/2004 | Pawloski et al. | |

FOREIGN PATENT DOCUMENTS

| | | | | |
|---|---|---|---|---|
| JP | 63-062349 | U | 4/1988 | |
| JP | 4339768 | A | 11/1992 | |
| JP | 04339768 | W | 11/1992 | |
| JP | 08268442 | A * | 10/1996 | B65D 33/00 |
| JP | 9118343 | A | 6/1997 | |
| JP | 09118343 | W | 6/1997 | |
| JP | 200320047 | A | 1/2003 | |
| JP | 200320047 | W | 1/2003 | |
| WO | 2008041647 | R | 4/2008 | |

OTHER PUBLICATIONS

Office Action dated Jul. 25, 2012 from the European Patent Office in corresponding patent application EP 07828784.4.

* cited by examiner

EASILY OPENABLE FASTENER TAPE, PACKAGING BAG WITH EASILY OPENABLE FASTENER TAPE, AND METHOD OF MANUFACTURING EASILY OPENABLE FASTENER TAPE

TECHNICAL FIELD

The present invention relates to an easily openable zipper tape having an engagement portion where a male member and a female member are engaged with each other, a packaging bag provided with the easily openable zipper tape and a method for producing the easily openable zipper tape.

BACKGROUND ART

As a packaging material for packaging various articles such as foods, medicines, medical products and miscellaneous goods, a packaging bag provided with a fastener tap is applied. The belt-shaped zipper tape is provided at an opening of the bag, including a pair of a male member and a female member that are engaged with each other to be openable and resealable.

The above packaging bag provided with the zipper tape is sealed by sealing an upper side of the zipper tape. In opening the bag, a film of a main body of the bag is opened in a manner to be torn from a starting position such as notches that are formed on both sides of the bag.

In the above packaging bag provided with the zipper tape, the zipper tape is harder than the film, so that the film is linearly torn along the proximity of the zipper tape where edges on the opening-side of the zipper tape contact with each other. Accordingly, it is difficult to put a finger into between the films or the zipper tapes. Therefore, a technique that allows a user to easily put a finger into between films or zipper tapes to hold an opening of a bag has been desired.

Exemplary solutions include a technique that opposing films are cut in different levels so as to avoid aligning with each other and a technique, as described in Patent Document 1, that different tape widths are applied on a male member and a female member of the zipper tape and the opening-side edges of the tape are not sealed so as to prevent the opening-side edges of the zipper tape from being bonded with each other.

[Patent Document 1] JP-A-09-118343

DISCLOSURE OF THE INVENTION

Problems to be Solved by the Invention

However, even if the opposing films are cut at different levels, the male member and the female member of the tape are only asymmetrical, which does not mean that the opening is easily opened, and it is difficult to hold one of the zipper tapes with a short holding portion.

Further, even if the edges of the tapes at the opening-side are not sealed as described in Patent Document 1, the unsealed edges of the tapes sometimes cannot be held, so that the tapes are not easily opened.

Additionally, when a typical zipper tape is heat-sealed with a bag, a tape portion is integrated with a base film before the tape is cured, so that it is difficult to hold the tape when the bag is opened.

An object of the invention is to facilitate holding of opposing films of the packaging bag when the engagement of the zipper tape is opened after the packaging bag is torn and to provide an easily openable zipper tape, a packaging bag provided with the easily openable zipper tape and a method for producing the easily openable zipper tape.

Means for Solving the Problems

An easily openable zipper tape according to an aspect of the invention to be attached to an inner surface of a bag body of a packaging bag, includes: an engagement portion in which a pair of a male member and a female member are engaged; and belt-shaped bases respectively connected with the engagement portion, in which at least one of the belt-shaped bases includes: a main body on which the engagement portion is provided; a thin portion that is provided on an opening-side of the main body and is thinner than the main body and bendable; and a thick portion that is provided on an opening-side of the thin portion and thicker than the thin portion; and surfaces of the main body and the thick portion respectively opposing to the inner surface of the bag body are located on a substantially same plane, and a gap is provided by the thin portion recessed relative to the surfaces.

In the above aspect of the invention, the thin portion that is thinner than the main body is provided on the opening-side of the main body provided with the engagement and the thick portion that is thicker than the thin portion is provided on the opening-side of the thin portion. Since the thin portion is recessed relative to a plane where the main body and the thick portion are attached to the inner surface of the bag body, the attachment of the zipper tape to the inner surface of the bag body of the packaging bag provides a gap between the thin portion and the base film of the packaging bag. In other words, due to the gap provided where the zipper tape is not fused along the base film, the base film contacting with the gap is easily bent to simultaneously bend the thinly formed thin portion.

Accordingly, when the packaging bag attached with the zipper tape is opened, since the thin portion is bent to open the opening of the packaging bag, opposing films of the packaging bag can be easily held so that the packaging bag can be easily opened.

In the easily openable zipper tape according to the above aspect of the invention, the thin portion preferably has 10 to 80% of a thickness relative to a thickness of the main body.

In the above aspect of the invention, since the thickness of the thin portion is set at 10 to 80% relative to the thickness of the main body, the thin portion is easily bent and the thin portion is not erroneously cut. The thickness of the thin portion is specifically 10 to 200 μm, for instance. When the thickness of the thin portion is less than 10 μm, the bag is not only easily cut in being opened but also difficult to be made and possible to be cut even in the making process. When the thickness of the thin portion is greater than 200 μm, the bag is difficult to be bent.

However, the thickness differs according to a material of the tape.

In the easily openable zipper tape according to the above aspect of the invention, the thick portion is preferably provided with a thick projecting portion on a surface of the thick portion.

In the above aspect of the invention, since the thick projecting portion is provided in the thick portion, the projecting portion is held by a finger in opening the bag, leading to an easy opening.

A packaging bag provided with a zipper tape according to another aspect of the invention includes: the easily openable zipper tape attached to a bag body; and an opening formed along edges on a side of the thick portions of the easily openable zipper tape of the bag body.

In the above aspect of the invention, since the above-mentioned easily openable zipper tape is attached, a packaging bag provided with the zipper tape can produce the same advantage. Incidentally, the packaging bag provided with the zipper tape is opened by tearing the bag body along the edge on the side of the thick portion of the zipper tape.

In the packaging bag provided with the zipper tape according to the above aspect of the invention, the above-mentioned easily openable zipper tape except for the thin portion is preferably fused to the bag body.

In the above arrangement, since the above-mentioned easily openable zipper tape is fused to the bag body except for the thin portion, the zipper tape is more easily bent, thus providing a packaging bag provided with the more easily openable zipper tape.

A method for producing the easily openable zipper tape according to still another aspect of the invention includes co-extruding the above-mentioned easily openable zipper tape in a single step.

In the above aspect of the invention, since the easily openable tape is produced by co-extrusion in a single step, the producing process can be simplified and facilitated.

A method for producing the packaging bag provided with the zipper tape according to further aspect of the invention includes: providing the easily openable zipper tape on a bag body and fusing the zipper tape except for the thin portion on the bag body.

In the above aspect of the invention in which the above-mentioned easily openable zipper tape except for the thin portion on the bag body, the zipper tape is more easily bent and a packaging bag provided with the more easily openable zipper tape can be provided.

BEST MODE FOR CARRYING OUT THE INVENTION

Embodiments of the invention will be described below with reference to the attached drawings. In the description of the embodiments, the explanation of components with the same reference signs will be simplified or omitted.

First Embodiment

A first exemplary embodiment of the invention will be described with reference to FIGS. 1 and 2.

Figure 1:
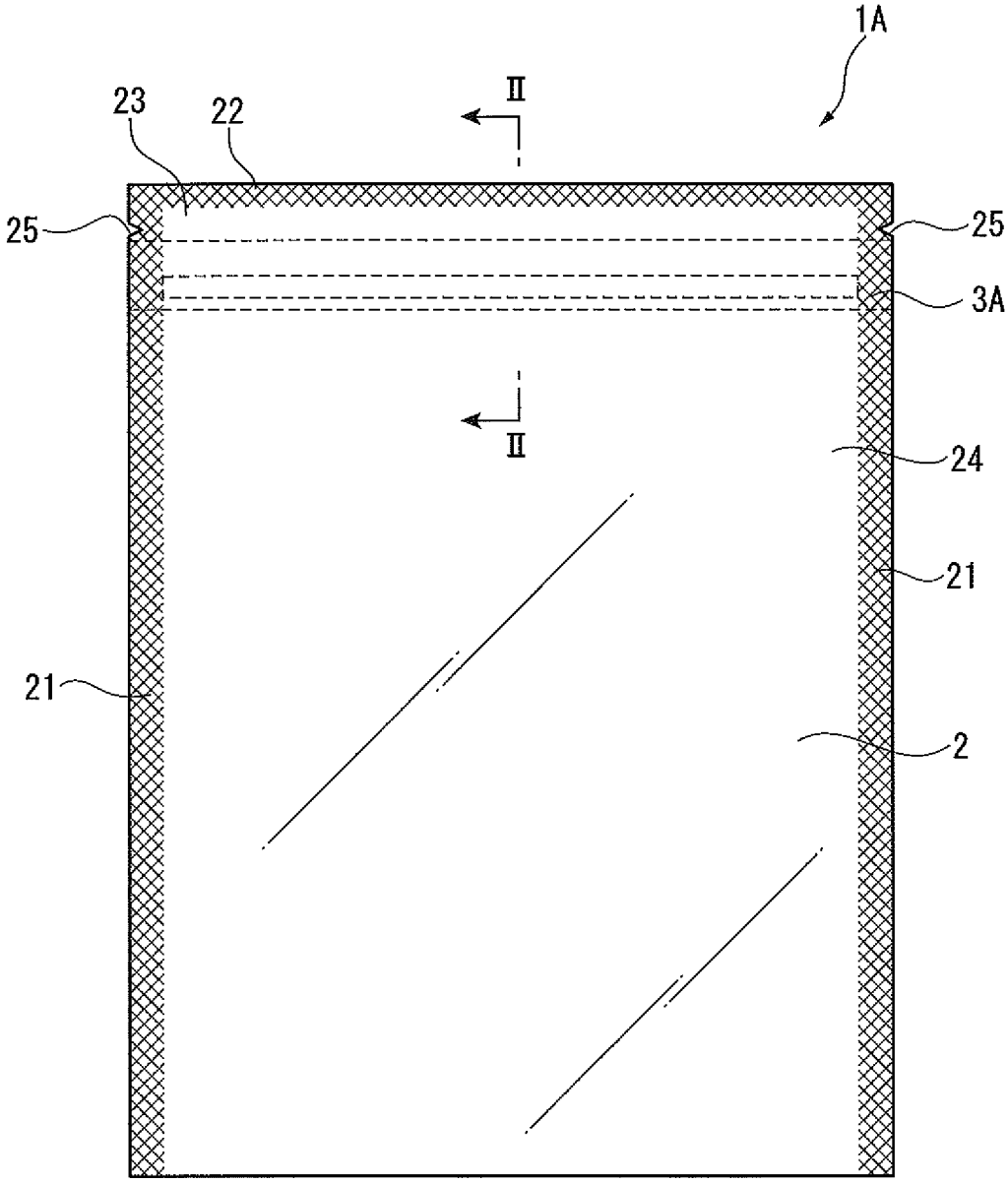
FIG. 1 is a front view showing a packaging bag provided with a zipper tape of a first exemplary embodiment of the invention.
Figure 2:
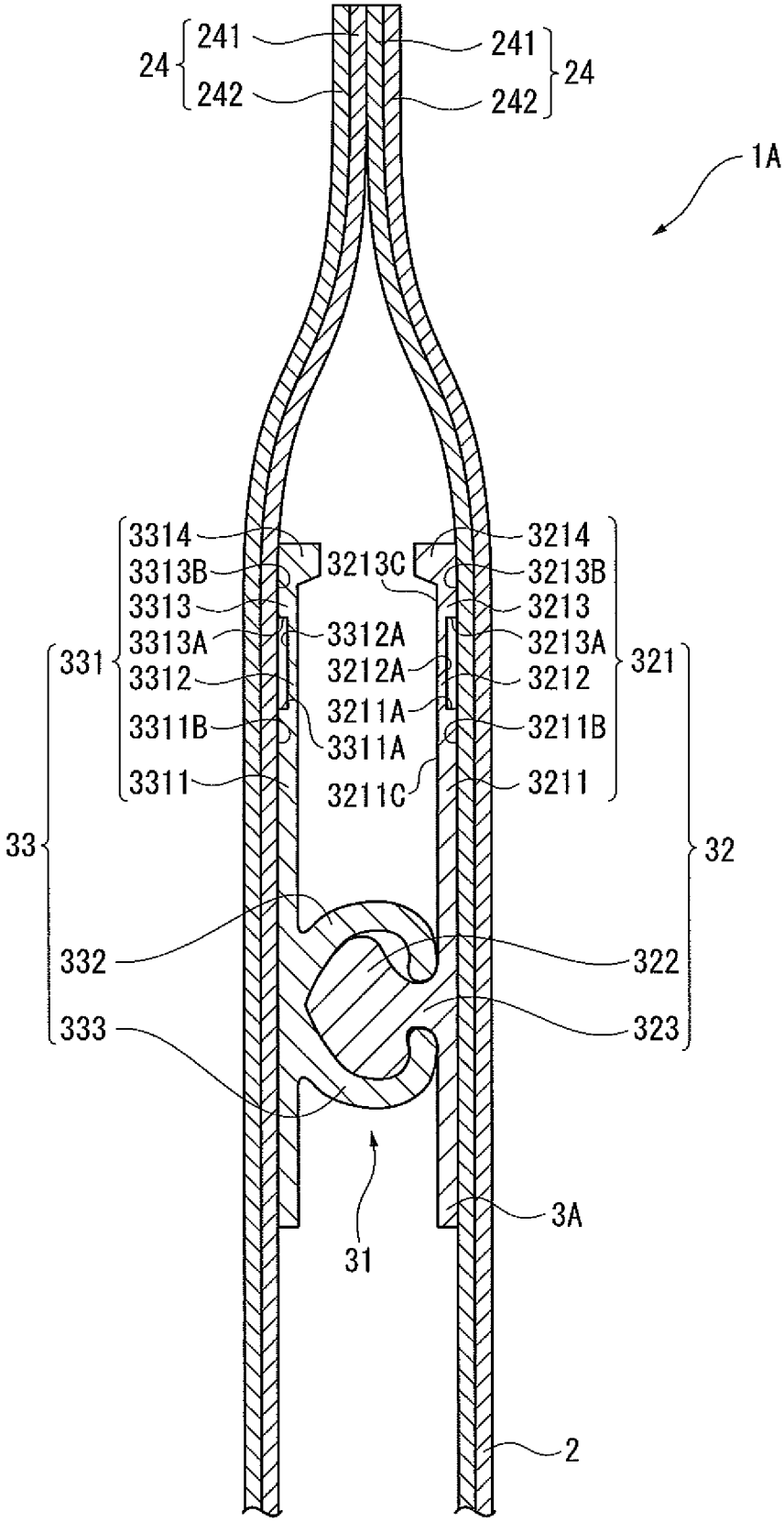
FIG. 2 is a cross section of the packaging bag provided with the zipper tape taken along II-II line in FIG. 1.

FIG. 1 is a front view showing a packaging bag provided with a zipper tape of the first exemplary embodiment of the invention and FIG. 2 is a cross section of the packaging bag provided with the zipper tape taken along II-II line in FIG. 1.

As shown in FIG. 1, the packaging bag 1A with the zipper tape of the first exemplary embodiment includes a bag body 2 that is formed by superposing base films 24 (packaging materials) on each other and providing side seal portions 21 and a top seal portion 22 on the periphery of the base films 24. A zipper tape 3A is attached on an inner surface of an opening 23 of the bag body 2. At both ends of the bag body 2 on the side adjacent to the opening 23 and spaced apart from the zipper tape 3A, notches 25 are provided as a cutting starting position to open the packaging bag 1A with the zipper tape.

FIG. 2 is a cross section of the zipper tape 3A. The zipper tape 3A includes a pair of a male member 32 and a female member 33. The male member 32 has a united arrangement of a belt-shaped base 321 fused to the bag body 2, a head 322 having a substantially arrow-tip shaped cross section and a connecting portion 323 for connecting the belt-shaped base 321 and the head 322. The female member 33 includes, similarly to the above-described male member 32, a belt-shaped base 331 fused to the bag body 2 and a first hook portion 332 and a second hook portion 333 that are integrally formed with the belt-shaped base 331 and have an arc-shaped cross section respectively, the first and second hook portions 332 and 333 facing with each other.

An engagement portion 31 of the zipper tape 3A is provided by the head 322 of the male member 32 and the first and the second hooking portions 332 and 333 of the female member 33, which are disengaged and engaged to open and reclose the bag.

The belt-shaped base 321 includes a main body 3211 provided with the engagement portion 31, a thin portion 3212 provided on the opening-side of the main body 3211 and a thick portion 3213 provided on the opening-side of the thin portion 3212. The thick portion 3213 is provided with a projecting portion 3214 that is thicker than the thick portion 3213.

The main body 3211 has a thickness of a typical zipper tape (100-250 μm), which is, for instance, 150 μm. The thin portion 3212 has a thickness of 100 μm, which is equivalent to approximately 67% of the thickness of the main body 3211. The projecting portion 3214 is thicker than the main body 3211, having a thickness of 300 μm. The projecting portion 3214 requires a thickness enough to be held by fingers, which is preferably 200-1000 μm.

A surface 3211B of the main body 3211 on the side adjacent to the base film 24 and a surface 3213B of the thick portion 3213 on the side adjacent to the base film 24 are located substantially on the same plane. The thin portion 3212 is provided at a position recessed relative to the above surfaces.

Similarly to the above-described belt-shaped base 321, the belt-shaped base 331 includes a main body 3311 provided with the engagement portion 31, a thin portion 3312 provided to the opening-side of the main body 3311 and a thick portion 3313 provided to the opening-side of the thin portion 3312. The thick portion 3313 is provided with a projecting portion 3314 that is thicker than the thick portion 3313.

Similarly to the above-described belt-shaped base 321, the main body 3311, the thin portion 3312 and the projecting portion have a thickness of 150 μm, 100 μm and 300 μm respectively.

Similarly to the above-described thin portion 3212 of the belt-shaped base 321, the thin portion 3312 of the belt-shaped base 331 is provided at a position retracted from the surface 3311B of the main body 3311 on the side adjacent to the base film 24 and the surface 3313B of the thick portion 3313 on the side adjacent to the base film 24.

The zipper tape 3A according to such an arrangement is fused on the inner surface of the bag body 2, resulting in a gap defined by a film of the bag body 2, a surface 3212A of the thin portion 3212, a surface 3211A of the main body 3211 and a surface 3213A of the thick portion 3213 in the male member 32. Similarly, in the female member 33, a gap is defined by the thin portion 3312, the film of the bag body 2, a surface 3311A of the main body 3311 and a surface 3313A of the thick portion 3313.

When the zipper tape 3A according to such an arrangement is heat-sealed to the inner surface of the bag body 2, non-cured part is provided on the zipper tape 3A with heat-sealing except for the thin portion. As a result, the zipper tape 3A is easier to be bent, so that the packaging bag 1A provided with a more easily openable zipper tape can be obtained.

The zipper tape 3A is integrally manufactured by a co-extrusion method. The coextrusion method simplifies the manufacturing process and reduces the manufacturing cost, so that the zipper tape 3A can be continuously and stably manufactured.

Herein, as long as the male member 32 and the female member 33 of the zipper tape 3A are openable and resealable, the material thereof is not specifically limited. However, it is preferable that the male member 32 and the female member 33 are formed by a polyolefin resin such as a polyethylene resin including typical low-density polyethylene and linear low-density polyethylene and a polypropylene resin. As the polypropylene resin, a thermoplastic resin such as homopolypropylene, block-polypropylene, random polypropylene (RPP), propylene-ethylene-butene-1 random ternary copolymer and a polyolefinic specialty soft resin (TPO resin such as prime polymer TPO) and a mixture thereof are used.

A resin used for the thin portions 3212 and 3312 of the zipper tape 3A is not specifically limited, but a typical resin for a zipper tape is used. Besides the above materials, polyethylene naphthalate (PEN), polybuthylene terephthalate (PBT), cyclic olefin copolymer (COC) and the like are exemplified.

Further, the resins used for the thin portions 3212 and 3312 and the main body of the zipper tape 3A can be the same or different.

Although a laminate film in which a sealant layer 241 is laminated over a base layer 242 is preferably used as the base film 24 (packaging material) for forming the bag body 2, a laminate film in which an intermediate layer (not shown) such as a gas barrier layer, a light-shielding layer and a strength-reinforcing layer is provided between the base layer 242 and the sealant layer 241 may be used depending on a required performance.

Besides a biaxially-oriented polypropylene film (OPP film), a biaxially-oriented polyamide film such as a biaxially-oriented polyethylene terephthalate film (PET film), nylon 6, nylon 66 and MXD6 (polymethaxylene adipamide) is preferably used as the base layer 242. Various engineering-plastic films can be also used according to the need. Further, the above films can be singly used or laminated in combination for use.

When the intermediate layer is the gas barrier layer, saponified ethylene-vinyl acetate copolymer (EVOH) and an aluminum foil can be used as the intermediate layer.

When a vapor-deposition layer of silica, alumina and aluminum or a coating layer of PVDC is used, the inner surface of the base layer 242 may be deposited or coated to form the vapor-deposition layer or the coating layer, or a biaxially-oriented nylon film (ONy film), a biaxially-oriented polyethylene terephthalate film (PET film) and a biaxially-oriented polypropylene film (OPP film) are evaporated or coated and then the obtained film can be laminated on the intermediate layer.

When the base layer 242 and the film of the intermediate layer are laminated, known dry lamination method or extrusion lamination method (sandwich lamination method) may be employed.

Low-density polyethylene, polypropylene (CPP) and the like can be used for the innermost sealant layer 241.

Incidentally, in order to laminate the sealant layer 241, the above resins are formed as a film, followed by being laminated by the dry lamination method or the extrusion lamination method. Alternatively, the above resins are laminated by the extrusion coating to obtain the base film 24.

Thus obtained base film 24 and the zipper tape 3A are used to manufacture the packaging bag 1A with the zipper tape by a zipper tape-attaching three-side seal bag-making machine and the like.

The zipper tape-attaching three-side seal bag-making machine includes a tape feeder, a packaging-material feeder and a zipper tape fusing section. The zipper tape 3A fed from the tape feeder is disposed between a pair of base films 24 fed from the packaging-material feeder and the zipper tape 3A and the base films 24 are fused at the zipper tape fusing section. Subsequently, the base films 24 are transferred to be fused and melt-cut at a predetermined interval in the transferring direction of the base films 24 to form the packaging bag 1A with the zipper tape.

Next, a method for opening the packaging bag 1A with the zipper tape according to this exemplary embodiment will be described below.

When being opened, the packaging bag is opened in a manner to be torn starting from either one of notches 25 provided on the both sides of the bag body 2 adjacent to the opening 23 and spaced apart from the zipper tape.

Next, fingers are put into between the opposing base films 24 of the unsealed packaging bag 1A and respective base films 24 are held by the fingers and pulled away in an opening direction, so that the engagement portion 31 is disengaged to open the packaging bag.

Figure 3:
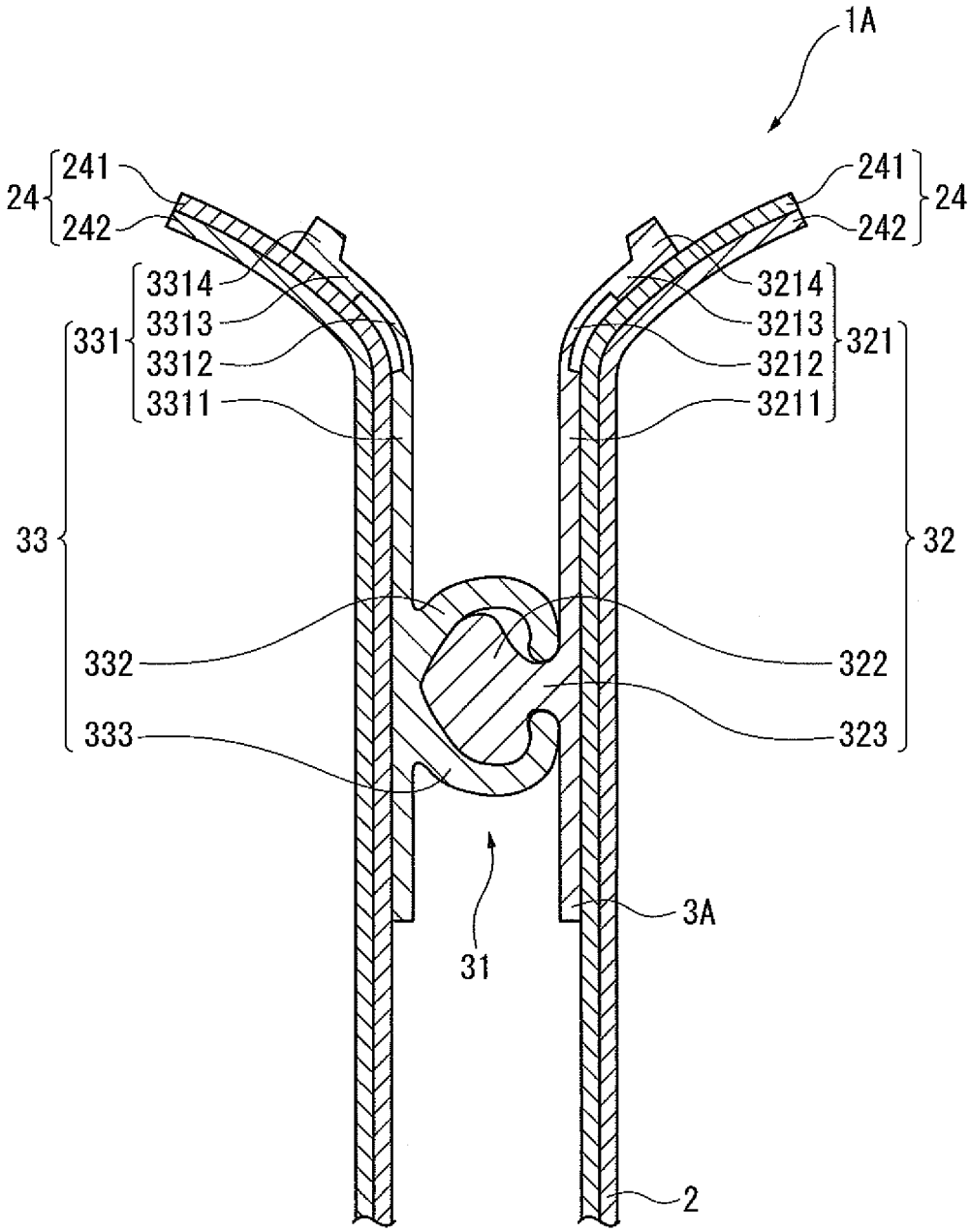
FIG. 3 is a cross section of the packaging bag provided with the zipper tape in FIG. 2 being opened.

FIG. 3 is a cross section of the packaging bag 1A with the zipper tape when fingers are put into between the base films 24. As shown in FIG. 3, the base films 24 and the zipper tape 3A are bent in the opening direction at the thin portions 3212 and 3312, so that the opening 23 is opened. Subsequently, the base films 24 that are opened to be easily held are held by fingers and pulled away in the opening direction, so that the engagement portion 31 is disengaged.

When the packaging bag is re-closed, the male member 32 and the female member 33 are engaged to engage the engagement portion 31.

According to the above-described zipper tape 3A and the packaging bag 1A with the zipper tape, following advantages can be achieved.

(1) In the zipper tape 3A according to this exemplary embodiment, the male member 32 has the thin portion 3212 in the belt-shaped base 321, so that a gap is provided by the base film 24 of the bag body 2, the thin portion 3212, the main body 3211 and the thick portion 3213 when the zipper tape 3A is fused to the bag body 2.

Similarly, the female member 33 has the thin portion 3312 in the belt-shaped base 331, so that a gap is provided by the base film 24 of the bag body 2, the thin portion 3312, the main body 3311 and the thick portion 3313 when the zipper tape 3A is fused to the bag body 2.

As described above, the gap is provided at a position contacting with the base film 24, so that the base film 24 which is more flexible than the thin portion 3312 is easily bent in a direction in which the opening 23 is opened. Simultaneously, the thin portion 3312 is bent, so that the opening in the packaging bag 1A with the zipper tape is opened.

Consequently, the base films 24 can be held, so that the packaging bag 1A with the zipper tape is easily opened.

(2) The thick projecting portions 3214 and 3314 are easily held by fingers, so that the opening 23 can be easily opened.

(3) The male member 32 provided with the main body 3211 having the engagement portion, the thin portion 3212 and the thick portion 3213 having the projecting portion 3214 and the female member 33 provided with the main body 3311 having the engagement portion, the thin portion 3312 and the thick portion 3313 having the projecting portion 3314 can be respectively manufactured in one step by co-extrusion method, which can be easily manufactured without less work load and production cost.

Second Embodiment

Figure 4:
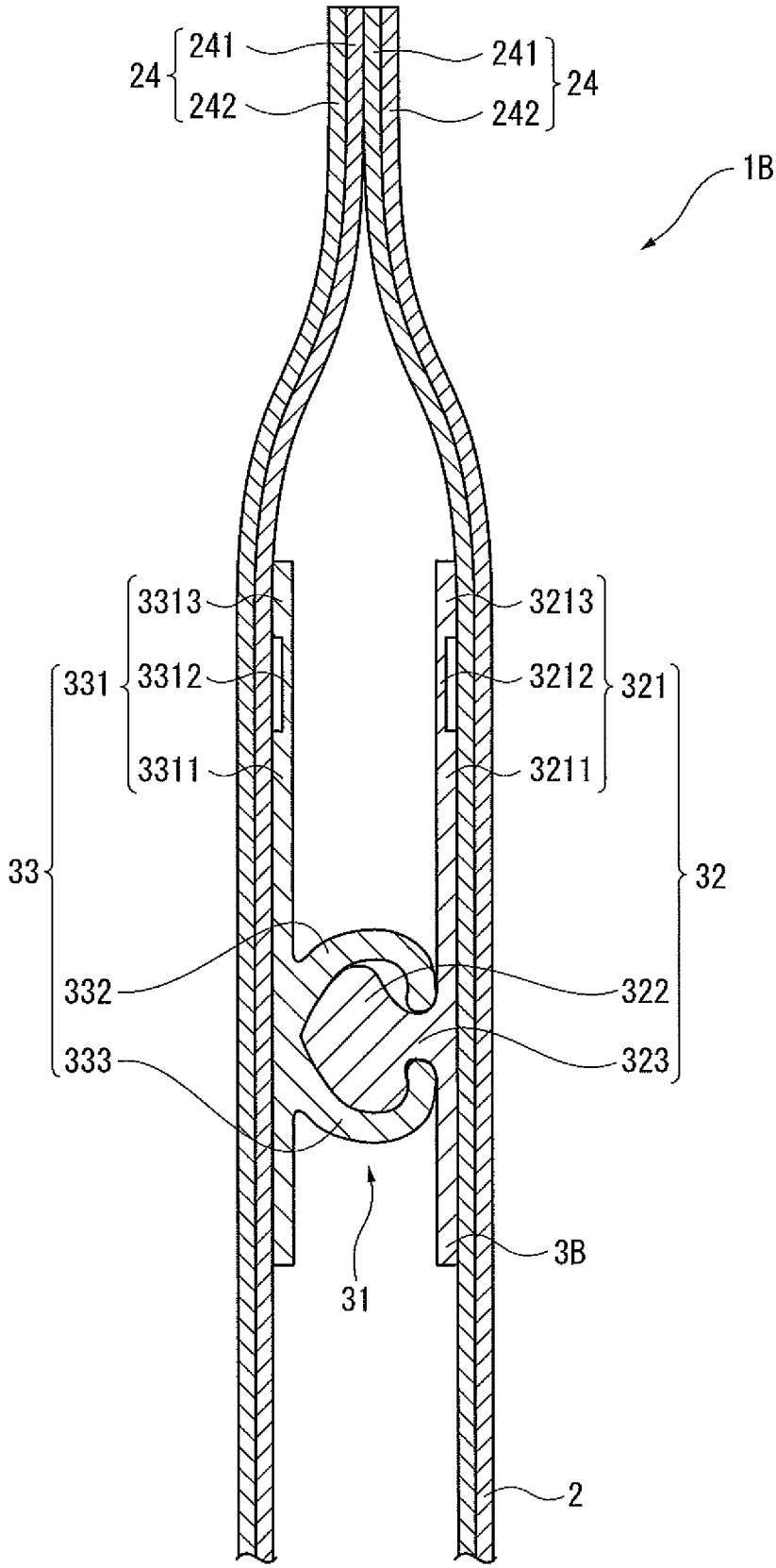
FIG. 4 is a cross section of a packaging bag provided with a zipper tape of a second exemplary embodiment.
Figure 5:
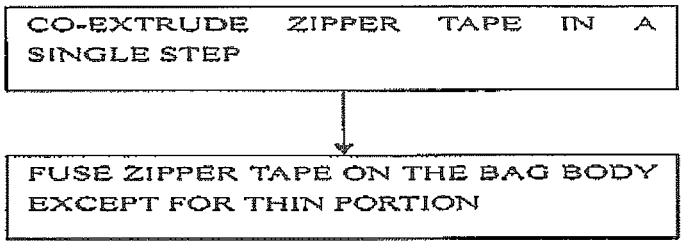
FIG. 5 is a flowchart showing the steps of the manufacturing process.

Next, a second exemplary embodiment of the invention will be described below with reference to FIG. 4. FIG. 4 is a cross section of a packaging bag 1B with a zipper tape of the second exemplary embodiment of the invention.

The present exemplary embodiment is the same as the first exemplary embodiment except that the thick portions 3213 and 3313 are not provided with the projecting portions 3214 and 3314 but have a different thickness respectively, where the same structure will not be mentioned below.

In the second exemplary embodiment, the thickness of the main bodies 3211 and 3311 and the thick portions 3213 and 3313 is not specifically limited as long as a thickness of a typical zipper tape is applied. However, the thickness is preferably large enough to be held by a finger. For example, the thickness is set at 200 μm. The thickness of the thin portions 3212 and 3312 is set at 100 μm.

When being opened, similarly to the first exemplary embodiment described above, the packaging bag is unsealed in the manner to be torn starting from either one of notches 25 provided on both sides of the bag body 2 adjacent to the opening 23 and remote from the zipper tape 3B.

Next, fingers are put into between the opposing base films 24 of the packaging bag 1B that has been unsealed and respective base films 24 are held by the fingers and pulled away in an opening direction, so that the engagement portion 31 can be disengaged.

In such an arrangement of the second embodiment, the same advantage as (1) and (3) of the first embodiment described above can be achieved.

Incidentally, it should be understood that the scope of the invention is not limited to the above-described exemplary embodiment(s) but includes modifications and improvements as long as the modifications and improvements are compatible with the invention. Further, the specific arrangements and configurations may be altered in any manner as long as the modifications and improvements are compatible with the invention.

For example, the thin portions, thick portions and the projecting portions are provided in both male and female members in this exemplary embodiment, but can be provided in either one of male and female members. Even with such an arrangement, one of the thin portions is bent in opening the opening of the packaging bag provided with the zipper tape, so that the base film can be easily held.

Further, the gap can be substantially semicircular, rectangular, triangular and in an arc. A plurality of the gaps may be provided.

Still further, in this exemplary embodiment, although the thin portion 3212 is recessed relative to the surfaces 3211B and 3213B of the main body 3211 and the thick portion 3213 of the belt-shaped base 321 to be attached on the inner surface of the bag body 2, the thin portion 3212 may be recessed relative to the surfaces 3211C and 3213C on the side of the engagement portion 31 of the main body 3211 and the thick portion 3213 of the belt-shaped base 321. The same arrangement is also applicable to the thin portion 3312.

In the above exemplary embodiment, the packaging bag on which the zipper tape 3A is fused is provided as a three-side seal bag, but the packaging bag is not limited to this in the invention. The zipper tape can be applied to a pillow-bag with three-side seal and a bag with four-side seal.

EXAMPLE

As shown in the following Examples and a Comparison, packaging bags were respectively examined in holdability by variation of shapes of the zipper tape and materials of the film.

Example 1

Polypropylene (density 900 kg/m$^3$, MFR 7.0 g/10 min) was used to obtain the zipper tape (the first exemplary embodiment) having the thin portion and the projecting portion by co-extrusion. The thickness of the main body, the thin portion and the projecting portion was respectively 150 μm, 100 μm and 300 μm.

A film produced by dry-laminating the zipper tape, a biaxially-oriented nylon film (15 μm) and a linear low-density polyethylene film (50 μm) were made into a bag by a zipper tape-attaching three-side seal bag-making machine to obtain a bag with a zipper tape.

Example 2

A zipper tape without a projecting portion (the second embodiment) was obtained by co-extrusion. Through the same procedure as in the Example 1, a packaging bag provided with a zipper tape was obtained.

Example 3

Through the same procedure as in the Example 2 except for heat-sealing a zipper tape to a bag except for a thin portion, a packaging bag provided with a zipper tape was obtained.

Example 4

The zipper tape used in the Example 1 and a film prepared by dry-laminating a biaxially-oriented polypropylene film (20 μm) and a cast polypropylene film (30 μm) were made into a bag to obtain a bag with a zipper tape.

Comparison 1

A zipper tape without a thin portion and a projecting portion was obtained by co-extrusion. Through the same procedure as in the Example 1, a packaging bag provided with a zipper tape was obtained.

Evaluation of Holdability

A: very easy to hold
B: easy to hold
C: difficult to hold

TABLE 1

| | Holdability |
|---|---|
| Example 1 | A |
| Example 2 | B |
| Example 3 | A |
| Example 4 | A |
| Comparison 1 | C |

In the Examples 1-4, opposing films of the packaging bag were easily held and opened.

In the Comparison 1, films of the packaging bag were difficult to be held and the packaging bag was not easily opened.

The invention claimed is:

1. An easily openable zipper tape suitable for attachment to an inner surface of a bag body of a packaging bag, said zipper tape comprising:

a pair of a male member and a female member that are engaged to define an engagement portion;

a first belt-shaped base having a male member side facing the male member and a first side opposite the male member side; and a second belt-shaped base having a female member side facing the female member and a second side opposite the female side, the male member being unsymmetrical relative to a center axis substantially perpendicular to the male member side to define an opening side, the male member being attached to the first belt-shaped base in a manner that the opening side is adapted to face an opening of the packaging bag, and a content side opposite the opening side across the center axis;

wherein said first and second belt-shaped bases each comprises a main body, on which said male or female member is provided, a single thin portion provided only in the opening side, and a thick portion; the main body having a greater length than the thin portion, the single thin portion being interposed between the body and the thick portion, said single thin portion being thinner than said main body and the thick portion and being bendable, said single thin portion defining a gap which is provided on only the first side or the second side, the thickness of said single thin portion being 10 to 80% of the thickness of the main body; and a surface of said main body and a surface of said thick portion are located on substantially the same plane, and said gap defined by said single thin portion is recessed relative to said surfaces of said main body and said thick portion, a surface of said thick portion being provided with a projecting portion that is thicker than said thick portion, said projecting potion projecting only from the side of the first and second belt-shaped bases on which said male member side or female member side is provided.

2. The zipper tape according to claim 1, wherein said first belt-shaped base and said second belt-shaped base are only connected to one another by the engagement of said male member and said female member.

3. The zipper tape of claim 1, wherein the projecting portion is thicker than the main body, the thick portion, and the thin portion.

4. A packaging bag provided with a zipper tape, comprising:

a bag body and an easily portable zipper tape according to claim 1;

wherein said first belt-shaped base and said second belt-shaped base, except for the thin portion, are fused to the inner surface of the bag body of the package bag;

wherein said bag body has means for opening said bag body on an edge adjacent said thick portion of at least one of the first and second belt-shaped bases; and wherein said single thin portion is suitable to be bent when the packaging bag is opened after the zipper tape is attached to the inner surface of the bag body.

5. The packaging bag provided with a zipper tape according to claim 4, wherein said zipper tape is positioned on said inner surface of the bag body so that said thick portion is adjacent an opening of the packaging bag and said thick portion is between said opening of the packaging bag and said single thin portion.

6. A method for producing the easily openable zipper tape, comprising: co-extruding an easily openable zipper tape according to claim 1 in a single step.

7. A method for producing a packaging bag provided with an easily openable zipper tape, comprising: providing an easily openable zipper tape according to claim 1 on a bag body and fusing said zipper tape, except for said thin portion, on said bag body.

* * * * *

UNITED STATES PATENT AND TRADEMARK OFFICE

CERTIFICATE OF CORRECTION

PATENT NO. : 8,753,011 B2
APPLICATION NO. : 12/443909
DATED : June 17, 2014
INVENTOR(S) : Nanba et al.

It is certified that error appears in the above-identified patent and that said Letters Patent is hereby corrected as shown below:

IN THE CLAIMS:

Column 9, line 15, Claim 1 reads as follows: -- female side, the male member being unsymmetrical --.

Should read as follows: -- female member side, the male member being unsymmetrical --.

Signed and Sealed this
Seventh Day of October, 2014

Michelle K. Lee

Michelle K. Lee
*Deputy Director of the United States Patent and Trademark Office*